US010582791B2

(12) United States Patent
Stevens

(10) Patent No.: US 10,582,791 B2
(45) Date of Patent: Mar. 10, 2020

(54) BEVERAGE-RETAINING INSERT

(71) Applicant: Joel Edward Stevens, Loveland, CO (US)

(72) Inventor: Joel Edward Stevens, Loveland, CO (US)

( * ) Notice: Subject to any disclaimer, the term of this patent is extended or adjusted under 35 U.S.C. 154(b) by 0 days.

(21) Appl. No.: 16/520,349

(22) Filed: Jul. 23, 2019

(65) Prior Publication Data

US 2020/0022517 A1 Jan. 23, 2020

Related U.S. Application Data

(60) Provisional application No. 62/702,251, filed on Jul. 23, 2018.

(51) Int. Cl.
*A47G 23/02* (2006.01)

(52) U.S. Cl.
CPC ..... *A47G 23/0241* (2013.01); *A47G 23/0266* (2013.01); *A47G 2023/0275* (2013.01)

(58) Field of Classification Search
CPC ..... A47G 23/00–0266; A47G 2023/0275
See application file for complete search history.

(56) References Cited

U.S. PATENT DOCUMENTS 3,205,678 A * 9/1965 Stoner ..... A47G 19/127 62/457.4
3,302,428 A 2/1967 Stoner et al.
4,163,374 A 8/1979 Moore et al.
4,299,100 A * 11/1981 Crisman ..... B65D 81/3883 220/592.17
4,372,453 A 2/1983 Branscum
4,378,625 A * 4/1983 Crisman ..... B65D 25/02 29/235
4,517,815 A 5/1985 Basso
4,741,176 A * 5/1988 Johnson ..... B65D 75/42 62/457.4
4,768,354 A * 9/1988 Barnwell ..... B65D 81/3883 220/592.17
5,261,554 A * 11/1993 Forbes ..... A45C 11/20 220/592.16
5,325,988 A * 7/1994 Ekern ..... B65D 81/3879 220/592.25

(Continued)

FOREIGN PATENT DOCUMENTS

WO WO2002070331 A1 9/2002

*Primary Examiner* — Kareen K Thomas

(57) ABSTRACT

A beverage-retaining insert is used to retain and orient a smaller beverage container, including but not limited to a soda can or beer bottle, within a larger beverage container, including but not limited to a tumbler, thermos, or travel mug. The larger beverage container is herein referred to as the tumbler. The apparatus is also configured to prevent damage and unwanted shifting or movement of the bottle or can relative to the tumbler. The apparatus includes a retaining lip, a tubular brace, a tubular cushion, and a sealing mechanism. The retaining lip positions the apparatus atop a tumbler. The tubular brace enables arrangement of the apparatus within a tumbler. The tubular cushion provides support for a beverage container. The sealing mechanism retains the position of the present invention against the inside of a tumbler. Thus, the apparatus efficiently and effectively retrofits a tumbler to enable support of a beverage container.

19 Claims, 8 Drawing Sheets

(56) References Cited

U.S. PATENT DOCUMENTS

| | | | | | |
|---|---|---|---|---|---|
| 5,361,604 | A | * | 11/1994 | Pier | B65D 81/3883 62/371 |
| 5,564,583 | A | * | 10/1996 | Kelley | B65D 81/3876 220/23.83 |
| 6,039,207 | A | * | 3/2000 | Adamek | B65D 81/3879 215/303 |
| 6,206,223 | B1 | * | 3/2001 | Wicker | B65D 81/3879 220/375 |
| D838,473 | S | | 1/2019 | Stevens | |

* cited by examiner

BEVERAGE-RETAINING INSERT

The current application is a continuation-in-part (CIP) application of the U.S. design application Ser. No. 29/664,011 filed on Sep. 20, 2018 and claims a priority to the U.S. Provisional Patent application Ser. No. 62/702,251 filed on Jul. 23, 2018.

FIELD OF THE INVENTION

The present invention generally relates to a device for adapting beverage containers. More specifically, the present invention relates to a beverage-retaining insert that provides bottles, cans, and other such containers support while positioned within larger containers, such as tumblers.

BACKGROUND OF THE INVENTION

The beverage industry spans every continent, with advertisements and marketing consuming a large portion of modern media content. Large beverage conglomerates have streamlined the process of converting water and raw materials into consumable liquids, and subsequently providing those liquids in convenient forms to consumers. Bottles and cans have emerged as the primary mechanisms for beverage distribution, as manufacturing and transporting liquids in these forms allows for optimal product distribution.

However, once opened, the contents of an unopened bottle or can may become warm in improper conditions, leading to spoilage and poor taste. To counter these effects, many individuals are known to employ tumblers such as stainless mugs, double wall stainless steel travel mugs, and thermos bottles to transport beverages for later consumption. These devices, herein referred to generally as tumblers, are known to have standardized attachable ported caps or lids that may be opened to either drink directly through the caps or lids or removed entirely to allow access to the interior of the tumbler. Tumblers are available in various sizes ranging from individual cups to large canisters and jugs, all while sharing a similar interior structure and detachable top cap or lid. However, the tumblers are only designed to store fluids internally. Even with the caps or lids removed, the tumblers on the market today cannot effectively be used to contain other beverage containers. Attempting to hold a bottle or can inside the tumbler would require material shimming to prevent said item from moving freely inside the tumbler, and the cap or lid may not be attached to the tumbler given the height of various beverage containers that a user may wish to store within. Even if the internal beverage container is small enough to fit within the tumbler, reapplying the cap or lid will prevent the user from accessing the beverage. The most common way to sustain a low temperature is by adding ice, which has the unfortunate side effect of diluting the contained beverage. What is needed is an adapter that can allow a user to support a beverage container within a tumbler. Further desirable is a mechanism for preventing the beverage container from undesirable shifting or motion within a tumbler.

The present invention addresses these issues. The present invention aims to allow a user to easily store and consume a beverage from a given beverage container contained within an existing tumbler by providing a radial support that will index and cushion the beverage container within the external tumbler. A unique set of surface features will guide and fix a beverage container within the body of the present invention. An insulating layer may additionally be included to maintain beverage temperature and to provide a measure of damage resistance to the beverage supported therein. The shape and scale of the present invention may be adapted to function in conjunction with any beverage container known in the industry, either internally or externally. Such an arrangement enables a user to fill a tumbler with ice, ice packs, or other coolant, and then place a bottle or can atop that coolant within the present invention, thus keeping the contents of the bottle or can cold, accessible, and unfiltered.

DETAILED DESCRIPTION OF THE INVENTION

All illustrations of the drawings are for the purpose of describing selected versions of the present invention and are not intended to limit the scope of the present invention.

Figure 1:
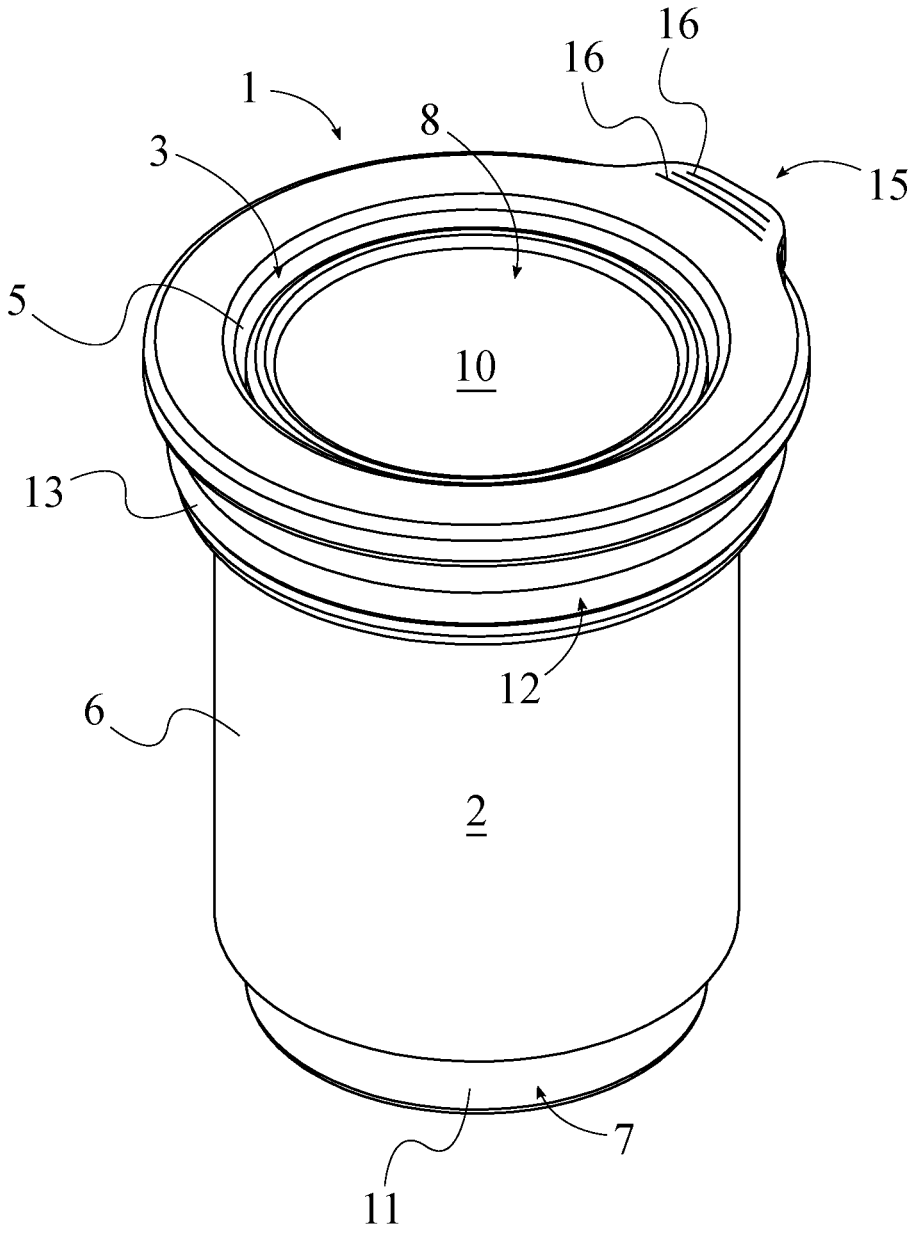
FIG. 1 is a top perspective view of the present invention.

The present invention is a beverage-retaining insert that is used to retain and orient a smaller beverage container, including but not limited to a soda can or beer bottle, within a larger beverage container, including but not limited to a tumbler, thermos, or travel mug. The larger beverage container is herein referred to as the tumbler. The present invention is also configured to prevent damage and unwanted shifting or movement of the bottle or can relative to the tumbler. The present invention comprises a retaining lip 1, a tubular brace 2, a tubular cushion 7, and a sealing mechanism 12, as seen in FIG. 1. The retaining lip 1 is a rigid annular device that is used to position the present invention atop a tumbler. The tubular brace 2 is a hollow cylindrical solid that enables arrangement of the present invention within a tumbler. The tubular cushion 7 is a preferably flexible hollow cylindrical or truncated conical semisolid device that provides support for a beverage container. The sealing mechanism 12 is an annular device which retains the position of the present invention against the inside of a tumbler.

Figure 4:
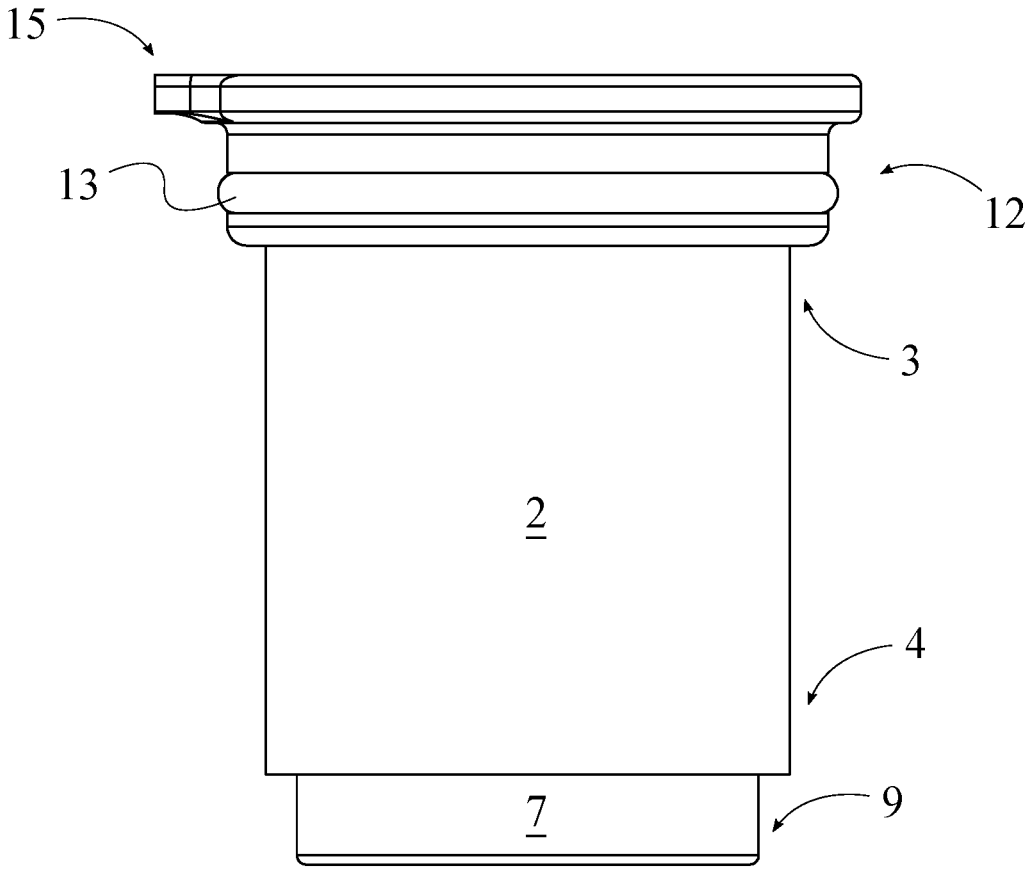
FIG. 4 is a side view of the present invention.
Figure 5:
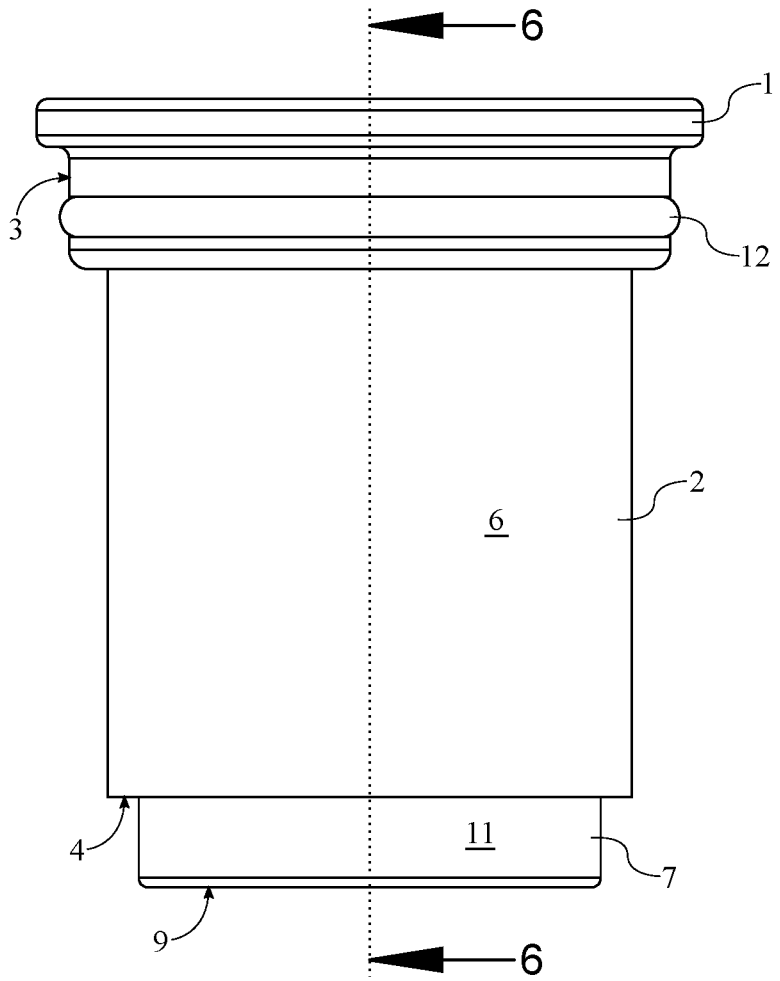
FIG. 5 is a rear view of the present invention.

The general configuration of the aforementioned components allows the present invention to efficiently and effectively retrofit a tumbler to enable support of a beverage container. The tubular brace 2 comprises a first brace end 3 and a second brace end 4, as seen in FIG. 4. The first brace end 3 is the segment of the tubular brace 2 through which a beverage container passes. The second brace end 4 is the segment of the tubular brace 2 opposite the first brace end 3 that, in the preferred usage of the present invention, extends into the tumbler. The tubular cushion 7 comprises a first cushion end 8 and a second cushion end 9. The first cushion end 8 is the segment of the tubular cushion 7 through which a beverage container may pass. The second cushion end 9 is the segment of the tubular cushion 7 opposite the first cushion end 8 that extends parallel to the second brace end 4. The tubular brace 2 is laterally mounted around the tubular cushion 7. Thus, the tubular cushion 7 is positioned to contact and interact with the beverage container, while the tubular brace 2 is positioned into the tumbler. The first brace end 3 and the first cushion end 8 are positioned coincident to each other. Therefore, items entering the present invention always pass through the first brace end 3 and the first cushion end 8. The retaining lip 1 is perimetrically connected around the first brace end 3. This arrangement ensures that the retaining lip 1 is appropriately positioned to support the present invention atop the opening rim of a tumbler. The sealing mechanism 12 is laterally mounted around the tubular brace 2. In this way, the sealing mechanism 12 is positioned optimally to prevent movement of the present invention during use, and to prevent cold air from exiting the tumbler while the present invention is engaged to the tumbler. Furthermore, the sealing mechanism 12 is positioned adjacent to the first brace end 3. This arrangement prevents shifting of the first brace end 3 during use.

Figure 3:
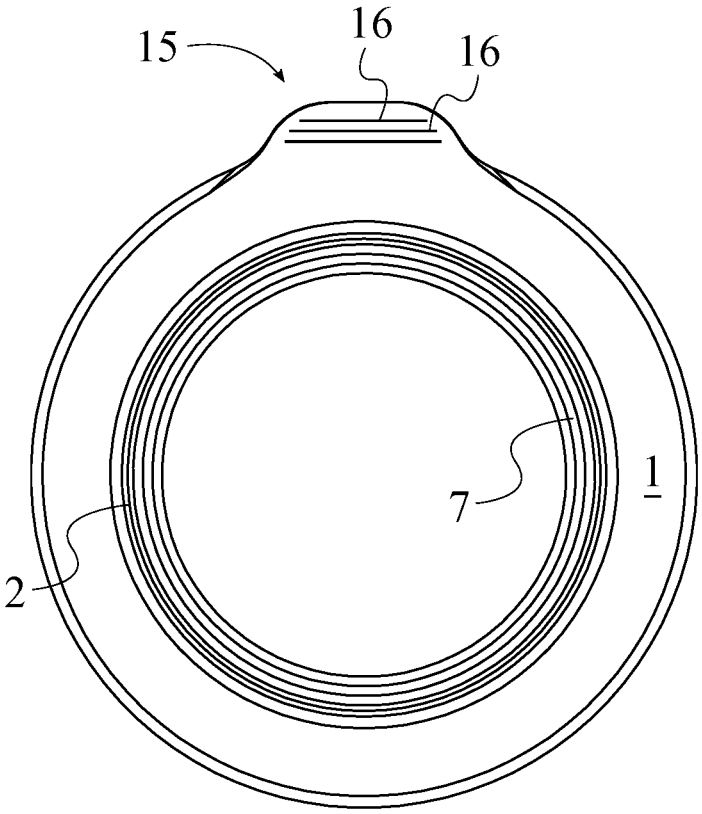
FIG. 3 is a top view of the present invention.

In order to facilitate removal and addition of the present invention to a tumbler, the user would benefit from the addition of a handle or other convenient protrusion. To provide such a mechanism, the present invention comprises a grip protrusion 15, as seen in FIG. 3. The grip protrusion 15 is a haft or other extrusion extending from the present invention. The grip protrusion 15 is laterally connected to the retaining lip 1. Such an arrangement provides the user with adequate leverage while adding or removing the present invention from a tumbler.

Figure 2:
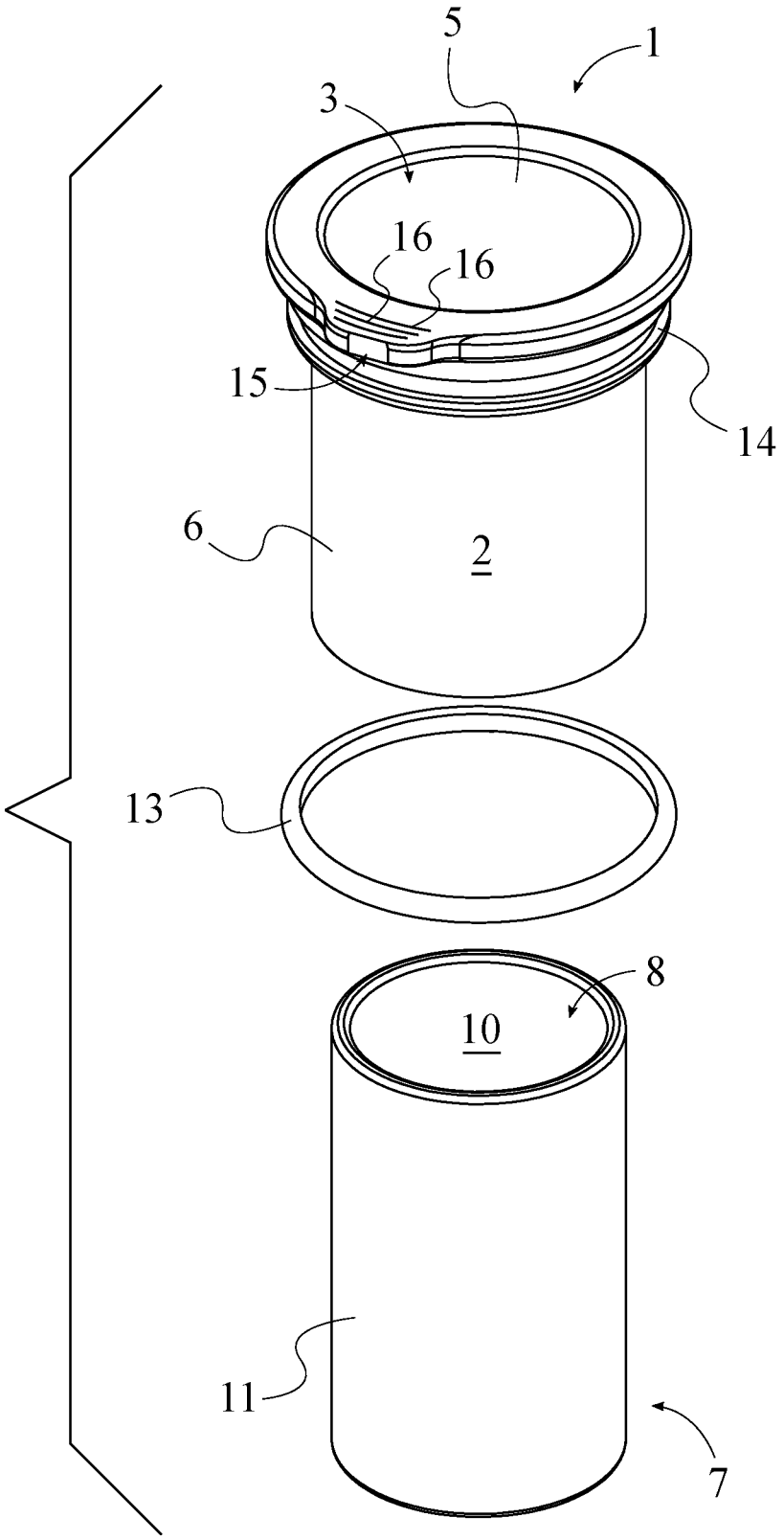
FIG. 2 is an exploded view of the present invention.

The grip protrusion 15 may be made more effective through the addition of bumps, textures, or other features that enhance the user's ability to interact with the grip protrusion 15. To this end, the present invention comprises a plurality of grip-enhancing features 16, as seen in FIG. 2. The plurality of grip-enhancing features 16 may be any or a combination of a set of concentric ridges, a knurling pattern, a vulcanized layer, or a variety of other mechanisms capable of improving the ability of the user to grasp the grip protrusion 15. The plurality of grip-enhancing features 16 is connected onto the grip protrusion 15. Such an arrangement ensures that the user can easily grasp the grip protrusion 15. In alternative embodiments, the plurality of grip-enhancing features 16 is connected around the retaining lip 1, thus allowing the user to grasp the retaining lip 1 directly rather than the grip protrusion 15.

The sealing mechanism 12 must be equipped to prevent any undesirable movement of the present invention from a tumbler and must further be able to create a thermal seal within the tumbler to prevent loss of cold air. To achieve this, the sealing mechanism 12 comprises an annular gasket 13 and an annular groove 14, as seen in FIG. 2. The annular gasket 13 is a preferably rubber or vulcanized polymeric material that creates a friction seal around the inside of the tumbler during use. The annular groove 14 is a channel that allows for positioning of the annular gasket 13. The annular groove 14 laterally traverses into the tubular brace 2. In this way, the annular groove 14 is adequately positioned to receive and retain the annular gasket 13. Furthermore, the annular gasket 13 is positioned into the annular groove 14. Therefore, the annular gasket 13 cannot move relative to the tubular brace 2 housing the annular groove 14.

Figure 6:
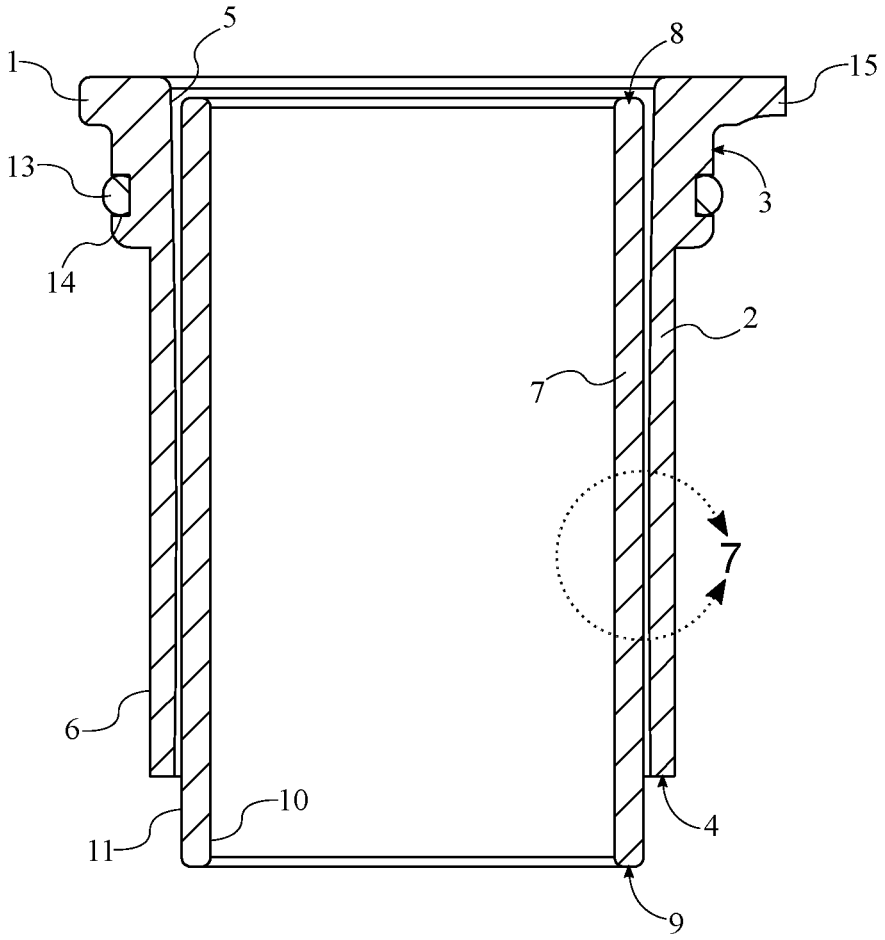
FIG. 6 is a cross-sectional view of the present invention taken along line 6-6 in FIG. 5.

The tubular cushion 7 must be positioned so as not to contact the tubular brace 2, else beverage containers might be at risk of damage. The second cushion end 9 is externally positioned to the tubular brace 2, as seen in FIG. 6. In this way, a beverage container within the tubular cushion 7 may not touch the tubular brace 2. In addition, the second cushion end 9 is offset from the second brace end 4. Thus, a beverage container within the tubular cushion 7 cannot come into contact with the tubular brace 2.

Figure 7A:
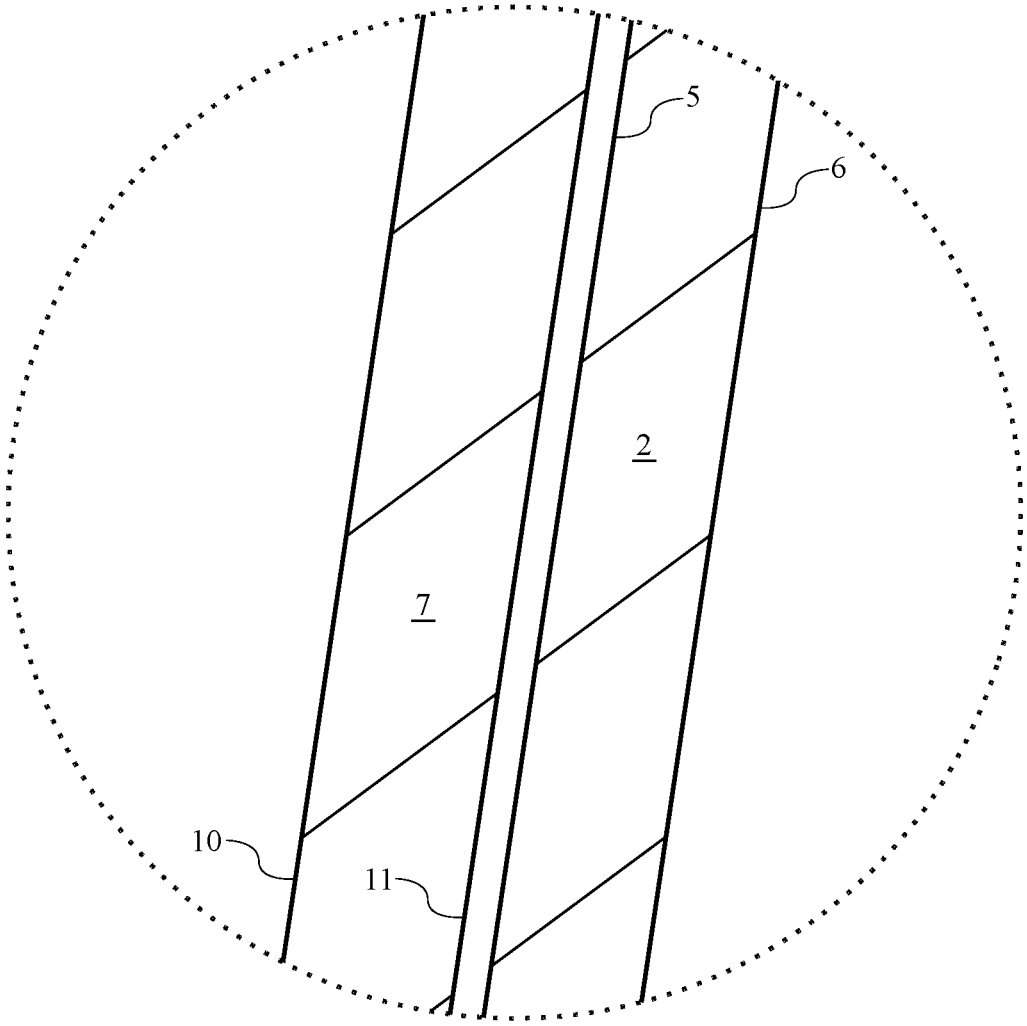
FIG. 7A is a detailed view of the present invention taken about circle 7 in FIG. 6, wherein the tubular cushion is positioned offset from the tubular brace.

The positioning of the tubular cushion 7 within the tubular brace 2 is preferably such that cold air or liquid can cool up the sides of the tubular cushion 7, thus creating an improved cooling system compared to the unidirectional cooling provided by simply placing a beverage container directly atop ice or other coolant substances. To achieve this, the tubular brace 2 further comprises an inner brace surface 5 and an outer brace surface 6, as seen in FIG. 7A. The inner brace surface 5 is a curved wall of the tubular brace 2 which faces the tubular cushion 7. The outer brace surface 6 is the curved wall opposite the inner brace surface 5 which allows the present invention to support itself against the inside wall of a tumbler. Similarly, the tubular cushion 7 further comprises an inner cushion surface 10 and an outer cushion surface 11. The inner cushion surface 10 is a curved wall which preferably contacts the outside of a beverage container during use. The outer cushion surface 11 is a curved wall opposite the inner cushion surface 10 which denotes the width of the tubular cushion 7 within the tubular brace 2. In one exemplary embodiment, the first brace end 3 is perimetrically connected around the first cushion end 8. In this way, the tubular brace 2 and the tubular cushion 7 form one monolithic structure. The inner brace surface 5 is positioned around the outer cushion surface 11. Thus, the inner brace surface 5 surrounds the tubular cushion 7. The inner brace surface 5 is also positioned offset from the outer cushion surface 11. Therefore, a space between the tubular cushion 7 and the tubular brace 2 allows for the flow of cooling fluids along the sides of a beverage container.

Figure 7B:
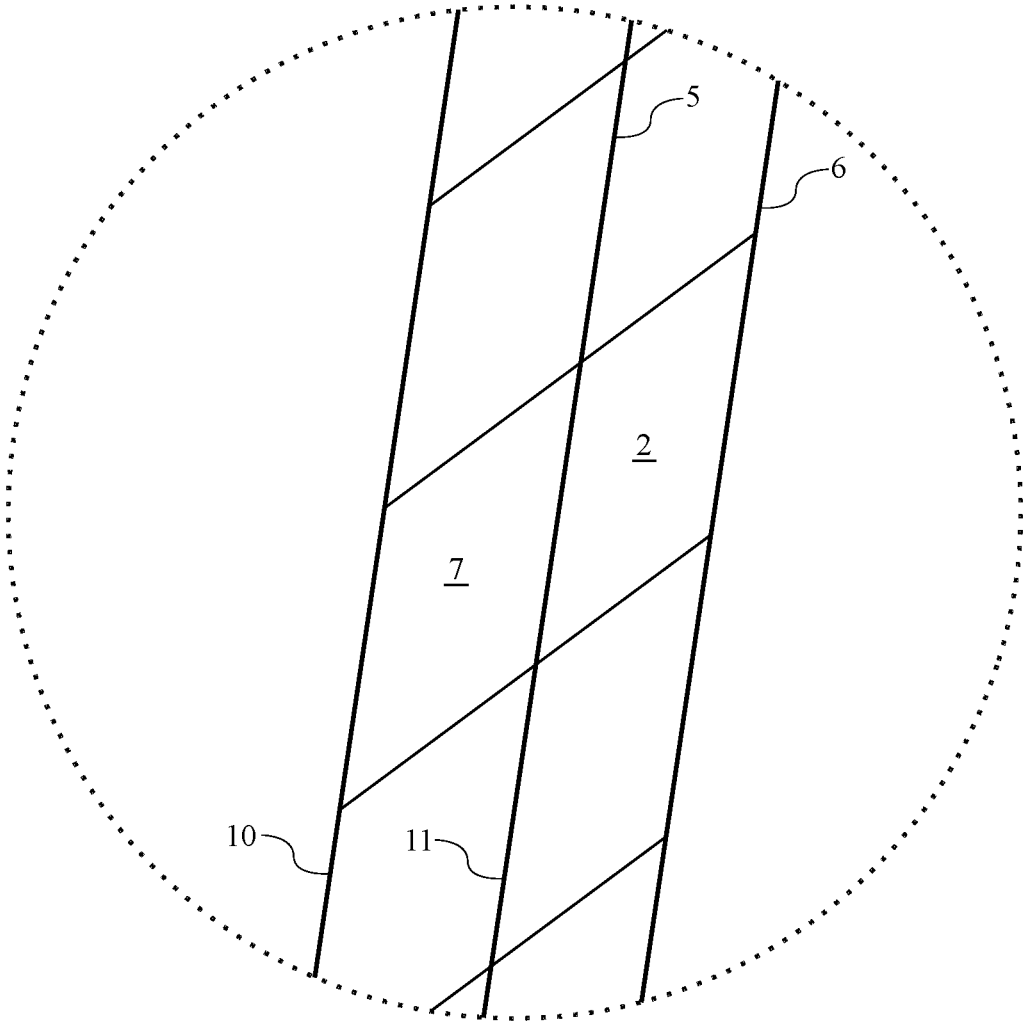
FIG. 7B is a detailed view of the present invention taken about circle 7 in FIG. 6, wherein the tubular cushion is positioned against the tubular brace.

In another embodiment, the user may wish to utilize the tubular cushion 7 separately from the tubular brace 2, as is commonly performed with a beer koozie. To this end, there is an alternative embodiment in which the first brace end 3 is not perimetrically connected around the outer cushion surface 11, as seen in FIG. 7B. This arrangement ensures that the beverage container moves uniformly with the motion of the tumbler. In this embodiment, the outer cushion surface 11 is pressed against the inner brace surface 5. Thus, while there is no cooling air flow up the sides of a beverage container, the beverage container is firmly positioned and oriented to both move with the tumbler and absorb any shock from accidental dropping of the tumbler.

In some versions of the present invention, the tubular brace 2 may benefit from a slight angle or taper in shape in order to better conform with the shape of a tumbler, as seen in FIGS. 7A and 7B. To this end, the tubular brace 2 further comprises an outer brace surface 6. The outer brace surface 6 is tapered from the first brace end 3 to the second brace end 4. In this way, the tubular brace 2 is shaped to adapt to a sloped inner wall of the tumbler.

Similarly, the tubular brace 2 may benefit from a slight angle or taper in shape in order to better conform with the shape of the tubular cushion 7. To this end, the tubular brace 2 further comprises an inner brace surface 5. The inner brace surface 5 is tapered from the first brace end 3 to the second brace end 4. Thus, the tubular brace 2 is adapted to receive various configurations of the tubular cushion 7.

In addition, the tubular cushion 7 may experience improved contact with the tubular brace 2 through the appropriate addition of a taper. To this end, the tubular cushion 7 further comprises an outer cushion surface 11. The outer cushion surface 11 is tapered from the first cushion end 8 to the second cushion end 9. Therefore, the tubular cushion 7 is adapted to fit properly and securely within the tubular brace 2.

Similarly, the tubular cushion 7 may experience improved contact with beverage container through the appropriate addition of a taper. To achieve this, the tubular cushion 7 further comprises an inner cushion surface 10. The inner cushion surface 10 is tapered from the first cushion end 8 to the second cushion end 9. This arrangement ensures that beverage containers are secure within the tubular cushion 7.

In an exemplary use case of the present invention, the user inserts the present invention into a tumbler. The user orients the present invention so that the second cushion end 9 and the second brace end 4 can enter the tumbler. The user slides the present invention along the outer brace surface 6 into the tumbler until the retaining lip 1 touches the upper rim of the tumbler. From there, the user may add ice or other cooling items into the tumbler through the tubular cushion 7. The user then adds a beverage container into the tubular cushion 7. The beverage container is supported laterally by the tubular cushion 7. In an alternative embodiment, the beverage container may be supported from beneath by ice or other cooling agents.

Although the invention has been explained in relation to its preferred embodiment, it is to be understood that many other possible modifications and variations can be made without departing from the spirit and scope of the invention as hereinafter claimed.

What is claimed is:

1. A beverage-retaining insert comprises:
- a retaining lip;
- a tubular brace;
- a tubular cushion;
- a sealing mechanism;
- the tubular brace comprises a first brace end and a second brace end;
- the tubular cushion comprises a first cushion end and a second cushion end;
- the tubular brace being laterally mounted around the tubular cushion;
- the first brace end and the first cushion end being positioned coincident to each other;
- the retaining lip being perimetrically connected around the first brace end;
- the sealing mechanism being laterally mounted around the tubular brace;
- the sealing mechanism being positioned adjacent to the first brace end;
- the sealing mechanism comprises an annular gasket and an annular groove;
- the annular groove laterally traversing into the tubular brace; and
- the annular gasket being positioned into an annular channel.

2. The beverage-retaining insert as claimed in claim 1 comprises:
- a grip protrusion; and
- the grip protrusion being laterally connected to the retaining lip.

3. The beverage-retaining insert as claimed in claim 2 comprises:
- a plurality of grip-enhancing features; and
- the plurality of grip-enhancing features being connected onto the grip protrusion.

4. The beverage-retaining insert as claimed in claim 1 comprises:
- the second cushion end being externally positioned to the tubular brace; and
- the second cushion end being offset from the second brace end.

5. The beverage-retaining insert as claimed in claim 1 comprises:
- the tubular brace further comprises an inner brace surface and an outer brace surface;
- the tubular cushion further comprises an inner cushion surface and an outer cushion surface;
- the first brace end being perimetrically connected around the first cushion end;
- the inner brace surface being positioned around the outer cushion surface; and
- the inner brace surface being positioned offset from the outer cushion surface.

6. The beverage-retaining insert as claimed in claim 1 comprises:
- the tubular brace further comprises an inner brace surface and an outer brace surface;
- the tubular cushion further comprises an inner cushion surface and an outer cushion surface;
- the inner brace surface being positioned around the outer cushion surface; and
- the outer cushion surface being pressed against the inner brace surface.

7. The beverage-retaining insert as claimed in claim 1 comprises:
- the tubular brace further comprises an outer brace surface; and
- the outer brace surface being tapered from the first brace end to the second brace end.

8. The beverage-retaining insert as claimed in claim 1 comprises:
- the tubular brace further comprises an inner brace surface; and
- the inner brace surface being tapered from the first brace end to the second brace end.

9. The beverage-retaining insert as claimed in claim 1 comprises:
- the tubular cushion further comprises an outer cushion surface; and
- the outer cushion surface being tapered from the first cushion end to the second cushion end.

10. The beverage-retaining insert as claimed in claim 1 comprises:
- the tubular cushion further comprises an inner cushion surface; and
- the inner cushion surface being tapered from the first cushion end to the second cushion end.

11. A beverage-retaining insert comprises:
- a retaining lip;
- a tubular brace;
- a tubular cushion;
- a sealing mechanism;
- a grip protrusion;
- the sealing mechanism comprises an annular gasket and an annular groove;
- the tubular brace comprises a first brace end and a second brace end;
- the tubular cushion comprises a first cushion end and a second cushion end;
- the tubular brace being laterally mounted around the tubular cushion;
- the first brace end and the first cushion end being positioned coincident to each other;
- the retaining lip being perimetrically connected around the first brace end;
- the sealing mechanism being laterally mounted around the tubular brace;

the sealing mechanism being positioned adjacent to the first brace end;

the grip protrusion being laterally connected to the retaining lip;

the annular groove laterally traversing into the tubular brace; and the annular gasket being positioned into an annular channel.

12. The beverage-retaining insert as claimed in claim 11 comprises:

a plurality of grip-enhancing features; and the plurality of grip-enhancing features being connected onto the grip protrusion.

13. The beverage-retaining insert as claimed in claim 11 comprises:

the second cushion end being externally positioned to the tubular brace; and the second cushion end being offset from the second brace end.

14. The beverage-retaining insert as claimed in claim 11 comprises:

the tubular brace further comprises an inner brace surface and an outer brace surface;

the tubular cushion further comprises an inner cushion surface and an outer cushion surface;

the first brace end being perimetrically connected around the first cushion end;

the inner brace surface being positioned around the outer cushion surface; and the inner brace surface being positioned offset from the outer cushion surface.

15. The beverage-retaining insert as claimed in claim 11 comprises:

the tubular brace further comprises an inner brace surface and an outer brace surface;

the tubular cushion further comprises an inner cushion surface and an outer cushion surface;

the inner brace surface being positioned around the outer cushion surface; and the outer cushion surface being pressed against the inner brace surface.

16. The beverage-retaining insert as claimed in claim 11 comprises:

the tubular brace further comprises an outer brace surface; and the outer brace surface being tapered from the first brace end to the second brace end.

17. The beverage-retaining insert as claimed in claim 11 comprises:

the tubular brace further comprises an inner brace surface; and the inner brace surface being tapered from the first brace end to the second brace end.

18. The beverage-retaining insert as claimed in claim 11 comprises:

the tubular cushion further comprises an outer cushion surface; and the outer cushion surface being tapered from the first cushion end to the second cushion end.

19. The beverage-retaining insert as claimed in claim 11 comprises:

the tubular cushion further comprises an inner cushion surface; and the inner cushion surface being tapered from the first cushion end to the second cushion end.

* * * * *